United States Patent [19]

Conn et al.

[11] 4,201,335

[45] May 6, 1980

[54] MICROTEST PLATE CARRIER OVERSPEED PROTECTION DEVICE

[75] Inventors: Thomas E. Conn, Palo Alto; John R. Edwards, Mountain View, both of Calif.

[73] Assignee: Beckman Instruments, Inc., Fullerton, Calif.

[21] Appl. No.: 912,699

[22] Filed: Jun. 5, 1978

[51] Int. Cl.[2] ..... B04B 7/06

[52] U.S. Cl. ..... 233/26

[58] Field of Search ..... 233/1 B, 1 R, 23 R, 233/26

[56] References Cited

U.S. PATENT DOCUMENTS

| | | | |
|---|---|---|---|
| 3,101,322 | 8/1963 | Stallman et al. | 233/26 X |
| 3,674,198 | 7/1972 | Eberle | 233/26 |

*Primary Examiner*—George H. Krizmanich
*Attorney, Agent, or Firm*—R. J. Steinmeyer; F. L. Mehlhoff; William H. May

[57] ABSTRACT

A mechanical overspeed protection device incorporated in a microtest plate carrier used in a centrifuge rotor. A locking arm actuates into a blocking position on the microtest plates in the carrier to indicate that the carriers on the rotor have been subjected to an overspeed condition during the centrifugation run. A housing within the carrier microtest plate retains the arm in an unactivated position during operation below a specified force field. However, when the carrier experiences an overspeed condition, the locking arm is designed to have sufficient weight, so that in response to the centrifugally induced forces the arm will move out of the housing into an outward blocking position on the carrier plates. The insertion of new microtest plates in the carrier for additional centrifugation runs is prevented, since the locking arm is in its blocking position. The blocking position of the locking arm will notify the operator that other carriers should replace the ones which have been subjected to an overspeed condition.

6 Claims, 3 Drawing Figures

MICROTEST PLATE CARRIER OVERSPEED PROTECTION DEVICE

BACKGROUND OF THE INVENTION

The present invention is directed to microtest plate carriers for use on a swinging type of centrifuge rotor and, more particularly, is directed to an overspeed protection device for use on the microtest plate carrier.

Typically, microtest carriers are utilized in a centrifuge where the rotor heads or yokes are designed for relatively high speed applications. Therefore, the rotor frequently is rated and designed to operate at speeds several times the rated safe speed for the carrier itself. The force field associated with high speed centrifugation can result in damage to the carrier when it is rotated at a speed greater than that for which it is designed.

Some approaches to alert the user of microtest plate carriers of this potential problem incorporate some type of caution label which is attached to the carrier stating that it is not to be run above a certain rotational speed or is not to be subjected to a certain G loading. Since the design of the carriers is such that it may survive one overspeed run, without having any visible or readily noticeable deformation or defect, a user does not know if the carrier has previously been subjected to an overspeed condition. However, if a carrier is subjected to a second or third overspeed condition, the probability of significant failure in the carrier is greatly increased. Hence, caution labels are not a complete and adequate safety feature with respect to ensuring the user of the carriers that they have not been previously subjected to an overspeed condition.

An alternative approach would be to design a carrier with a significant margin of safety, so that, if it were run several times over the rated speed, it would have a sufficient resistance to fatigue as well as the higher centrifugal forces and withstand the adverse environment. However, the designing of the carriers with such a high margin of safety would present a prohibitively expensive carrier.

SUMMARY OF THE INVENTION

The present invention incorporates a mechanically actuated locking arm which moves from a recessed position within a housing to an actuated or indicator position in response to the higher centrifugal forces associated with an overspeed condition. when actuated to the indicator position, the locking arm is held permanently in that position due to a ratchet construction in the pivot area of the locking arm. Consequently, the user of the carrier will be unable to utilize it for further centrifugation runs, since removal of the existing microtest plates in the carrier is impossible without completely dismantling the carrier and destroying the activated overspeed protection device.

During its at-rest position and when the carrier is operating in proper speed ranges, the locking arm is held within its housing by a retaining ledge in the housing on which a flexible projection from the contact end of the locking arm rests. When the carrier is rotated at too high a speed, the centrifugally induced weight of the locking arm will force it to move out of its housing and cause the flexible projection to deflect out of its engagement with the retaining ledge in the housing.

Since the microtest plate carrier is designed to normally withstand one centrifugation run in an overspeed condition, the activation of the locking arm will notify the user that the carrier cannot be subjected to use again, since it may have been slightly damaged or fatigued in such a manner that it may not be safe for further centrifugation runs.

The present invention provides a unique and automatic method to alert the user of the rotor having the microtest plate carriers that an overspeed condition has occurred. The present invention does not utilize a complicated electrical circuit for overspeed detection and does not require the constant monitoring of the centrifuge to determine whether or not the centrifuge carrier has been subjected to an overspeed condition. The present invention automatically provides the user with evidence as to whether or not the carrier has been subjected to an overspeed condition. The operator will always be assured that, when the locking arm is properly positioned within its housing, the carrier has not been subjected to an overspeed condition and, therefore, is a good carrier to utilize in further centrifugation runs. The utilization of only warning labels on carrier provides no assurance to the user that the carrier has not been previously subjected to an overspeed condition that may create a hazardous situation when subjecting the carrier to continual repeated overspeed environments.

DETAILED DESCRIPTION OF THE INVENTION

Figure 1:
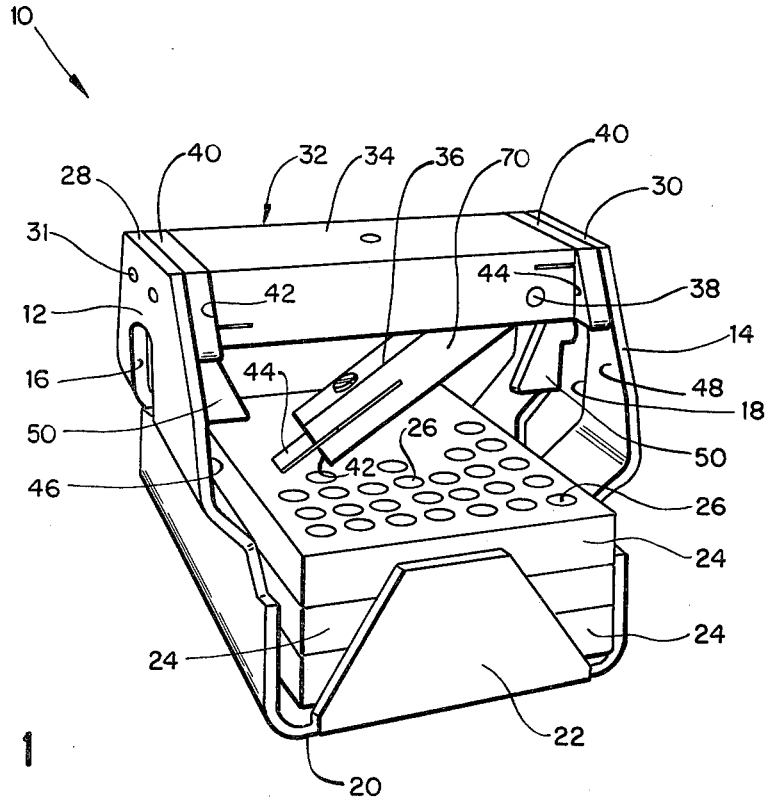
FIG. 1 is a perspective view of three microtest plates in a carrier with the locking arm of the present invention in its actuated position.

FIG. 1 shows a typical microtest plate carrier 10 having hanger portions 12 and 14 including respective hinge pin sockets 16 and 18 which are designed to receive hinge pins that are located on the yoke of the centrifuge rotor (not shown). The carrier 10 has a support surface or base 20 from which the hanger portions 12 and 14 extend upward with respect to FIG. 1 at approximately a 90° angle. Between the hanger portions 12 and 14 on opposite sides of the support base 20 are support walls 22. The hanger portions 12 and 14 in conjunction with the support base 20 and the support walls 22 form a receptacle or frame for receipt of one or more microtest plates 24. Each of these plates carriers a plurality of cells 26 which are designed to carry samples for centrifugation.

Rigidly mounted between the respective upper ends 28 and 30 of the hanger members 12 and 14 by screws or other fastening means 31 is an overspeed protection device 32 of the present invention. Incorporated within the overspeed detection device 32 is a locking arm housing 34 in which resides the locking or actuator arm 36 which is pivotally mounted on a pivot pin 38.

An insert 40 is positioned between the respective ends 42 and 44 of the locking arm housing 34 and the respective inside faces 46 and 48 of the hanger portions 12 and 14. The inserts 40 are designed to keep the upper ends 28 and 30 of the hanger members 12 and 14 correctly positioned with respect to the hinge pins on the rotor (not shown), so that during centrifugation the hanger portions 12 and 14 do not flex toward each other and possibly slip off the hinge pins. Also, each of the inserts 40 supports a limit guard 50 which limits the number of microtest plates 24 that can be loaded onto the carrier 10 to prevent overload of the carrier.

Figure 2:
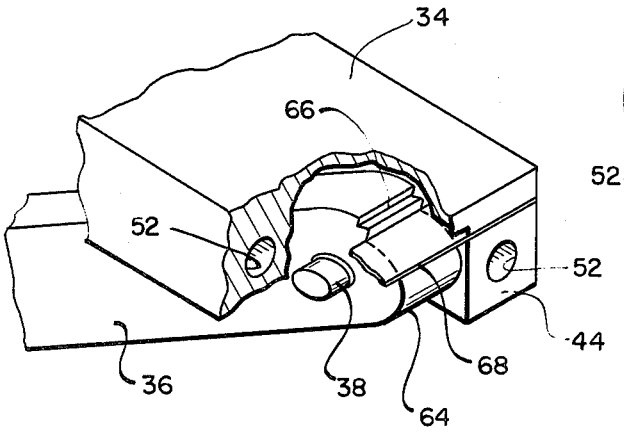
FIG. 2 is a partial perspective cut-away view of the pivot end of the locking arm of the present invention.
Figure 3:
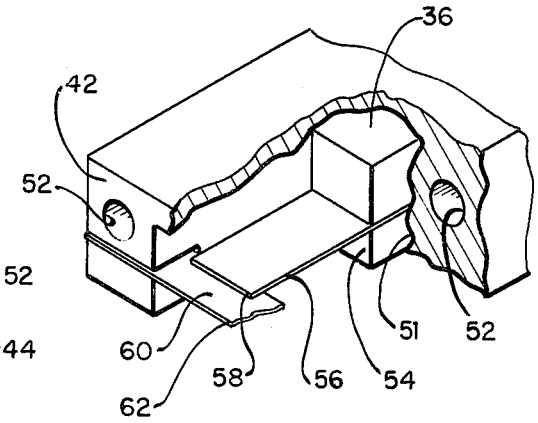
FIG. 3 is a partial perspective cut-away view of the contact end of the locking arm.

As shown in FIGS. 2 and 3, the housing 34 has a pair of longitudinal cavities 52 extending completely through the length of the housing. Each of the inserts 40 in FIG. 1 have a pair of holes (not shown) to align with the housing cavities 52. Support bars (not shown) are inserted through the holes of the inserts 40 as well as the housing cavities 52 and extending between the respective inside surfaces 46 and 48 of the hanger members 12 and 14. These bars in conjunction with the inserts 40 not only retain the proper spacing between the hanger portions 12 and 14, but also provide additional support to the overspeed device 32. The end portions of each support bar are hollow and are internally threaded to receive the fastening screws 31 to securely tie the overspeed device 32 to the carrier frame. It is envisioned that the fastening screws 31 or other fastening means will be made in such a manner that they cannot be removed without damaging the carrier.

As shown more clearly in FIG. 3, the actuator arm 36 is designed to reside within an elongated recess 51 in the housing 34 when the carrier 10 is at rest or operating below the overspeed rating for the carrier. Extending from the free or contact end 54 of the arm 36 is a flexible projection 56 that is designed to have its outer end 58 rest on the inside or top surface 60 of a retaining ledge 62. The retaining ledge 62 is securely mounted adjacent the one end 42 of the housing 34. When the arm 36 is subjected to significant centrifugal forces during an overspeed condition, the arm 36 will tend to move out of the recess 51 causng the projection 56 to flex out of engagement with the inside surface 60 of the ledge 62. The locking arm 36 will then move into its locked or indicator position as shown in FIG. 1.

As shown in FIG. 2, the locking arm 36 has its pivot end 64 mounted on the pivot pin 38. The pivot pin 38 is secured within the other end 44 of the housing 34. Also located on the pivot end 64 of the arm 36 are ratchet notches 66 which are designed to engage an indexing member 68 to prevent clockwise rotation of the arm 36 with respect to FIG. 2. Therefore, the ratchet junctions 66 and the indexing member 68 allow for counterclockwise rotation of the arm 36 as it moves to its locked or indicator position, but prevent clockwise motion of the arm 36.

Turning to the operation of the present invention, attention is directed to FIG. 1. When the carrier is at rest prior to the centrifugation run, the locking arm 36 is in a position recessed within the housing 34 and will not be visible. The microtest plates 24 are placed within the carrier frame between the holding brackets 12 and 14 of the pair of support walls 22. During centrifugation, the carrier will pivot about hinge pins which are inserted within the hinge pin sockets 16 and 18 to a position such that the support surface 20 as well as the microtest plates 24 will assume an almost vertical orientation. In other words, the carrier swings approximately 90° from a horizontal orientation to a vertical orientation. p In some instances the microtest plate carriers are positioned within rotors which are designed for speeds much greater than the speed rating for the carriers. Consequently, a user may inadvertently subject the carriers to an overspeed condition which may result in some damage to the carrier such that it should not be utilized for any further centrifugation runs. The overspeed protection device 32 of the present invention is designed to notify the user of the microtest plate carriers whether or not they have been subjected to an overspeed condition.

As shown in FIG. 3, when the carrier is at rest, or when it is operating at speeds which are below the rated overspeed limit, the locking arm 36 is positioned within the recess 51 of the housing 34. The projecting member 56 has its outer end 58 resting on the inside surface 60 of the retaining ledge 62. However, if an overspeed condition is reached, the weight of the locking arm is sufficient enough that the centrifugally induced forces exerted upon it will move it out of the recess 51, causing the flat flexible projecting member 56 to bend sufficiently enough to permit it to disengage from the retaining flange 62. Consequently, the contact end 54 of the locking arm 36 will pivot in a counterclockwise direction with respect to FIGS. 1 and 2 to a point where the contact end 54 of the arm 36 with its projecting member 56 will contact the uppermost microtest plate 24 in FIG. 1. While the locking arm 36 is rotated in its counterclockwise direction with respect to FIG. 2, the ratchet pivoted junctions 66 have under the indexing member 68. If a user attempts to move the actuator or locking arm 36 in a clockwise direction with respect to FIG. 2, a ratchet junction 66 will contact the indexing member 68 and prevent any clockwise motion of the arm. Consequently, the user of the carrier would be prevented from any further use of the carrier and the locking arm would prevent removal of the microtest plates without noticeable damage of the overspeed protection device 32.

It is envisioned that on the side 70 of the locking arm 36 a warning label of some type can be positioned for exposure when the locking arm reaches its actuated position to specifically notify the operator that the carrier had been subjected to an overspeed condition and that it should not be used for any further centrifugation runs.

If a user attempts to force the locking arm 36 back into the housing 34, the arm 36 will be damaged and a later user of the carrier will readily notice the damage. It is envisioned none of the moving parts are accessible to the user with respect to the overspeed protection device and, therefore, no accidental actuation is possible.

It should be recognized that alternative mechanical means could be utilized within the scope of this invention to indicate to the user that the carrier has been subjected to an overspeed condition. For example, the contact end 54 of the locking arm 36 could be retained within the housing 34 by means other than the flexible projection 56 and the ledge 62. As an example, a separate member could restrain the locking arm 36 below a specified force field, but would break and release the arm when the specified force field is exceeded. Other means in place of the ratchet arrangement could be incorporated to prevent the return movement of the arm into the housing once the arm has reached its indicator position.

In some instances it may be desirable to utilize an elongated member in place of the locking arm, so that the elongated member in response to a force field above a certain level would permanently deform or break to provide notice to the user that an overspeed condition has occurred. These and other changes to the specific construction of this invention shown on the drawings could be made without departing from the true spirit and scope of this invention.

What is claimed is:

1. A carrier assembly for pivotal mounting on a centrifuge rotor, said assembly comprising:

a frame for holding fluid samples, said frame being designed to operate below a specified force field; and means connected to said frame and responsive to a force field greater than said specified force for automatically locking said fluid samples within said frame to prevent reuse of said carrier.

2. A carrier as defined in claim 1, wherein said locking means comprises:

a housing;

a locking arm pivotally mounted within said housing; and means for retaining said arm within said housing when said force field is less than said specified level during centrifugation and for automatically releasing said arm from within said housing when said force field is greater than said specified level during centrifugation.

3. A carrier assembly as defined in claim 2 and additionally comprising means for permitting pivotal movement of said arm in one direction after said automatic release of said arm and for preventing pivotal movement of said arm in the opposite direction to said one direction.

4. The carrier assembly as defined in claim 3, wherein said permitting and preventing means comprises:

a plurality of ratchets on one end of said arm; and an indexing member in said housing for engaging one of said ratchets to prevent movement of said arm in said opposite direction.

5. A carrier assembly as defined in claim 2, wherein said retaining means comprises:

a flexible member on one end of said arm; and a retaining ledge in said housing adjacent said one end of said arm, said flexible member resting on the inside face of said retaining ledge.

6. A carrier assembly for pivotal connection to a centrifuge rotor, said assembly comprising:

a frame having a pair of hanger members for mounting on said rotor;

a housing connected to said carrier;

a locking arm pivotally mounted in said housing, said locking arm having a contact end and a pivot end;

means for retaining said contact end of said arm in a first position within said housing when said carrier is subjected to a force field below a specified level, said retaining means permitting said contact end to move out of said housing to a second position when said carrier is subjected to a force field greater than said specified level; and means for locking said free contact of said arm in said second position to prevent return movement of said arm to said first position.

* * * * *